US005267815A

United States Patent [19]

Feder

[11] Patent Number: 5,267,815

[45] Date of Patent: Dec. 7, 1993

[54] COMBINATION PROTECTIVE COVER AND DIVE GEAR STOWAGE AND RETRIEVAL SYSTEM FOR SCUBA AIR TANKS

[75] Inventor: Irving Feder, 19150 W. Dixie Hwy., Miami, Fla. 33180

[73] Assignee: Irving Feder, Miami, Fla.

[21] Appl. No.: 794,982

[22] Filed: Nov. 19, 1991

[51] Int. Cl.[5] ..... B63C 11/02

[52] U.S. Cl. ..... 405/186

[58] Field of Search ..... 405/185, 186, 187; 441/80, 88

[56] References Cited

U.S. PATENT DOCUMENTS 2,982,105 5/1961 Akers ..... 405/186
3,135,098 6/1964 Root ..... 405/186
4,752,263 6/1988 Pritchard et al. ..... 405/186 X
4,790,463 12/1988 Hansen ..... 405/186 X

*Primary Examiner*—David H. Corbin
*Attorney, Agent, or Firm*—Herbert L. Lerner; Laurence A. Greenberg

[57] ABSTRACT

A protective cover for SCUBA air tanks includes a tube of plastic material for snugly fitting around a body of a tank. The tube includes a substantially non-stretchable portion of plastic material having two side edges, and a resiliently stretchable portion of plastic material disposed between the two side edges, for allowing the tube to snugly fit tanks of various sizes. Attachment pads may be disposed on the non-stretchable portion for attaching auxiliary diving equipment. Various rings, clips, buckles or other fasteners are disposed on the tube for attaching auxiliary straps or carrying belts.

16 Claims, 1 Drawing Sheet

COMBINATION PROTECTIVE COVER AND DIVE GEAR STOWAGE AND RETRIEVAL SYSTEM FOR SCUBA AIR TANKS

BACKGROUND OF THE INVENTION

1. Field of the Invention

The invention relates to a protective and decorative cover for scuba diving tanks as well as to a dive gear stowage and retrieval system.

SCUBA tanks are subject to a great deal of wear and tear. They are subject to rough handling and often come into contact with concrete, coral, sand, rock, jagged metal edges on wrecks, etc. This has the inevitable effect of the tank often being severely scratched and defaced, which depreciates the value of the tank.

2. Description of the Related Art

Only a few comparable prior art devices of this general kind are known in the art. Firstly, a known fully closable carrying bag with a handle attached thereto is meant for storage or may be used for shipping the tank. Such a bag is not provided for improved aesthetics nor for use during diving activities.

Secondly, an expandable plastic mesh has been used in the art. A relatively thin tube of diamond shaped mesh is pulled over a tank and expands to conform to the size of the tank.

The plastic mesh is of a coarse material that fits very tightly over an average tank when expanded to the width of the tank. The mesh tube is difficult to slide on or remove because of the high coefficient of friction and because of the mechanical obstructions due to the many exposed coarse edges of expanded mesh.

The plastic materials which have been used in the art are not resilient, i.e. when the mesh is struck or bumped, the plastic flattens out permanently. Furthermore, the materials are soft and can be cut easily.

The nature of the expanded mesh is to allow partial visibility of the exterior surface of the tank. It only partially hides any poor appearance of the tank. Diving tanks are usually subject to very rough handling and are scratched and bumped quite frequently. The result is that they loose their aesthetically acceptable appearance after a short time and such appearance shows through the mesh.

Closing mechanisms on tank straps used with buoyancy compensation devices (BCD) that are required to be worn by SCUBA divers have a small difference in width between the open and closed position. This means that when a BCD is slipped over a tank the rough nature of the plastic mesh creates a friction that makes application and removal difficult. When the tank attachment strap is tightened, the plastic mesh tends to be flattened and deformed.

Finally, the last resort in the prior art has been to repaint a tank. Such repainting is dangerous in terms of the heating process used to dry a painted tank. This drying process can and has weakened tank structures, with the result that tanks have exploded.

It is accordingly an object of the invention to provide a protective cover for SCUBA air tanks, which overcomes the hereinafore-mentioned disadvantages of the heretofore-known devices of this general type and which provides a protective and decorative covering for SCUBA diving tanks. Furthermore, the tank cover should be easy to place over the tank and remove by use of fabric grip tabs which may be provided. Also, the tank cover should be constructed in such a way as to fit a variety of tank widths due to it's variable elasticity. The covering may be of a transparent flexible material, or fully opaque to hide or cover the appearance of the tank. Finally, the material may match the color of the tank, be in contrast, be patterned, decorated or marked with various symbols for identification and distinction purposes.

The tank cover, when fabricated from a durable fabric such as 400 Denier Nylon (the material used for fabricating Bouyancy Compensation Jackets), or 1000 Denier Nylon known as CORDURA, is an effective barrier against defacing due to the above-mentioned hazards for the tank, as they are common in sport and commercial diving.

In its normal use, a tank is secured to a bouyancy compensation jacket worn by a SCUBA diver. The jacket has an adjustable strap used to secure the tank. The smooth nature of the materials used in the tank cover according to the invention enables anyone to easily slip the BCD tank strap on and off the tank cover. This is an important feature when compared with the prior art, since the existing plastic mesh cover offers great resistance to ease of tank preparation and switching during diving activities.

A potentially infinite number of colors, textures, patterns, finishes and decorations are possible with the materials that can be used to fabricate the tank cover. It is therefore also a fashion object. The tank cover according to the invention can be distinguished by printing or marking individual custom markings and logos. This feature makes it easier to individualize and personalize a tank for identity purposes, for personal taste or even for advertising use. It also enables the easy identification of a buddy diver or a member of a particular group. Again, the prior art allows only a limited number of colors and large gaps in the plastic mesh which makes identification more difficult.

Basically, the tank skin cover is a protective and decorative covering with elastic properties that enables it to fit a variety of differently sized SCUBA diving tanks. Strategically placed pull tabs make installation and removal very easy. The material of the tank skin cover may be either elastic or some combination of elastic and non-elastic materials.

Furthermore, strategically placed D-rings help facilitate installation and removal from the tank. They can be used as attachment rings for auxiliary equipment, tools, accessories, for storage, security, etc. The D-rings further serve to attach belts or straps which are used for securing tanks against accidental slippage or as carrying straps to make moving tanks easier. The number and location of such tabs and rings may vary greatly.

Strategically placed VELCRO loop pads and removable pockets equipped with VELCRO hook pads are disposed on the tank cover. The loop pads are also used as contact points for various accessories and dive equipment which is, in turn, equipped with a VELCRO hook surface area.

It is accordingly seen that the tank cover of the invention is much more than just simply a protective cover, but instead it also serves a plurality of functions.

SUMMARY OF THE INVENTION

With the foregoing and other objects in view there is provided, in accordance with the invention, a protective cover for SCUBA air tanks, comprising a tube of flexible material for snugly fitting around a body of a tank, the tube including a substantially non-stretchable portion of material having two side edges, and a resiliently stretchable portion of material disposed between the two side edges, for allowing the tube to snugly fit tanks of various sizes.

In accordance with another feature of the invention, the body of the tank includes a cylindrical body portion with a given height and a top portion and the tube has a length adapted to the given height. The tube may either cover only the cylindrical portion of the tank or the other portions also.

In accordance with an added feature of the invention, an attachment pad disposed on the substantially non-stretchable portion for accessibly attaching auxiliary diving equipment.

In accordance with a further feature of the invention, the attachment pad is a loop pad of a hook-and-loop fastening material.

In accordance with yet another feature of the invention, the attachment pad is a plurality of pads disposed on the non-stretchable portion.

In accordance with yet a further feature of the invention, the resiliently stretchable portion is in the form of a plurality of resilient strips.

In accordance with again an added feature of the invention, the resiliently stretchable portion is in the form of a strip extending along the tube. The strip may also be in the form or a plurality of strips.

In accordance with again another feature of the invention, the cover includes an attachment ring disposed on the non-stretchable portion.

In accordance with an additional feature of the invention, the attachment ring is a plurality of rings disposed on the non-stretchable portion for attaching hooks and auxiliary straps to the tank.

In accordance with yet an additional feature of the invention, the cover includes means, which may be in the form of straps, for attaching the tube to the bottom and/or to the top of the tank for preventing the tank from slipping out of the tube.

In accordance with yet a further feature of the invention, an attachment strap is disposed on the non-stretchable portion for attaching the cover to a tank strap of a buoyancy compensation device.

In accordance with still a further feature of the invention, the tube has a bottom and a top, and a carrying strap is attached to the bottom and/or to the top.

With the objects of the invention in view, there is provided, in accordance with yet a further feature of the invention, a tube of material for snugly fitting around a body of a tank, attachment pads disposed on the tube in the form of hook-and-loop fastening material for attaching diving accessories, and means for securing the tube against slipping off the tank.

In accordance with an additional feature of the invention, the material is a resiliently elastic material having a low modulus of elasticity. Advantageously, the material is a plastic material, a mixture of natural and synthetic material, or it is a natural fabric.

In accordance with a concomitant feature of the invention, the tube is cylindrical, has a given diameter and includes a portion of substantially non-stretchable material and a portion of resiliently elastic material providing means for enlarging the given diameter at any location along the tube.

Other features which are considered as characteristic for the invention are set forth in the appended claims.

Although the invention is illustrated and described herein as embodied in a combination protective cover and dive gear stowage and retrieval system for SCUBA air tanks, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 7 is a perspective view of a clip/strap for attaching accessories and dive gear to the tank cover.

DESCRIPTION OF THE PREFERRED EMBODIMENTS

Figure 1:
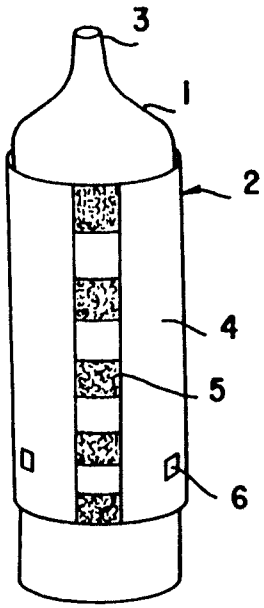
FIG. 1 is a perspective view of a SCUBA tank with a first embodiment of the cover according to the invention.

Referring now to the figures of the drawing in detail and first, particularly, to FIG. 1 thereof, there is seen a SCUBA tank 1 with a tank cover 2 according to the invention. The tank cover 2 forms a tube which adapts to the body of the air tank 1. The conventional features of the air tank 1 are only diagrammatically indicated such as, for example, a connector 3 having internal threads for a compressed air valve.

The tank cover 2 essentially has two portions, namely a substantially non-stretchable portion 4 and a resiliently stretchable portion 5. The non-stretchable portion 4 has two side edges which are connected by means of the stretchable portion 5. The relative sizes of the two sections 4 and 5 are interchangeable and easily determined by the person of skill in the art. The stretch modulus of the stretchable section 5 is chosen such that the tank cover snugly fits the tank, yet may be slipped onto the tank without problems. Furthermore, the stretchable section 5 shown in FIG. 1 is made up of several strips of elastic material. It lies furthermore within the scope of the invention to provide the tank cover with two or more vertical strips of elastic material.

It is equally possible, in a further embodiment of the invention, for the entire tank cover tube 2 to be of a somewhat stretchable material whose modulus of elasticity is appropriately chosen to ensure a snug fit around the tank and offers safe attachment possibilities for diving accessories, as well as offers enough stretchability to easily slip the cover over the air tank 1.

Loop pads 6 are provided toward the bottom of the tank cover. The loop pads 6 are a loop fabric of a hook-and-loop type fastener such as VELCRO. The size of the loop pads 6 may be varied according to the attachment strength requirements. As will be explained in the following, various articles, provided with corresponding strips of hook material, may be attached to the loop pads.

The tank cover may be used with one or more VELCRO straps. An advantageous strap would be 1" wide and approx. 12" long and made of a combination of or back to back hook and loop material. Such straps easily wrap around a flashlight, a dive gauge console, or any diving accessory and the strap is secured to itself. The diver can then very easily attached the wrapped and secured device to the loop pad 6 on the tank cover.

The main purpose of this hook and loop arrangement is to provide a means by which these accessories can be kept secured in a fixed yet very easily accessible location for preventing damage to reefs and also to the respective diving accessories. It has been customary in diving to leave guage consoles and regulator 2nd stages dangling freely below the diver while he or she is swimming horizontally.

The reason these devices are allowed to dangle freely is that the only alternative in the prior art has been to put them in a pocket or to attach them with a hook or a latch. This is very cumbersome, however, being that access and storage after use are difficult and time consuming. Additionally, it is often necessary to view the gauge repeatedly during a dive. Typically the gauges include a depth gauge, air pressure (volume) gauge, compass and a dive computer. The BC and the auxiliary diving equipment are not shown in the drawings since they are conventional and well-known diving equipment.

An octopus or spare 2nd stage air regulator is provided as emergency equipment, such as for rescuing a buddy diver who has run out of air or in the case of a mechanical breakdown of the primary 2nd stage regulator.

By use of the velcro strap and loop pad on the tank cover, a diver may reach for the same location for easy attachment and removal, for use or inspection. Additionally none of the pieces of auxiliary diving equipment will dangle freely and thus become damaged.

Also, it is often difficult to retrieve these devices, especially in strong currents, or when the diver is in a vertical heads up or heads down position.

Freely hanging devices also get caught in rocks, crevices, and narrow passageways when swimming through wrecks. These free hanging devices tend to scrape along the bottom and destroy any coral or fragile life forms.

Figure 2:
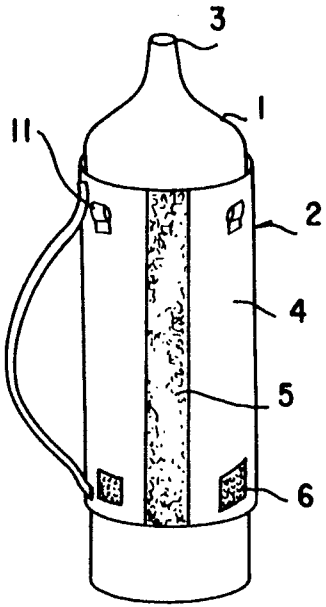
FIG. 2 is a view of a second embodiment of the cover of FIG. 1.

FIG. 2 shows a second embodiment of the tank cover according to the invention with a continuous strip of elastic material 5, instead of the several strips 5 shown in FIG. 1.

Figure 4:
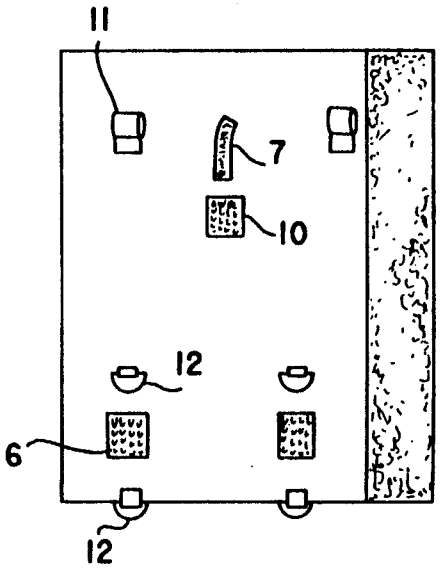
FIG. 4 is a front elevational view of an open tank cover according to the invention.
Figure 3:
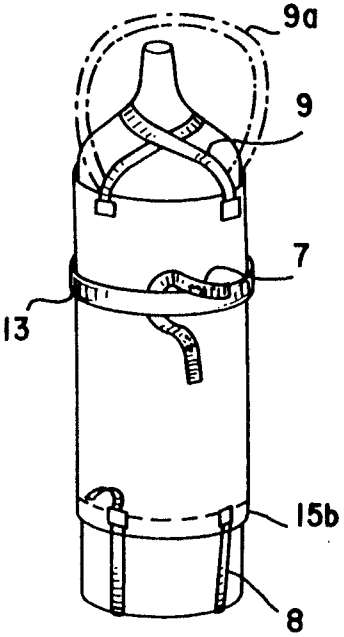
FIG. 3 is a view of the opposite side of the tank of FIGS. 1 and 2.

The embodiment shown in FIG. 3 has a strap 7 attached on the back side of the tank cover. The strap 7, again VELCRO or another hook and loop type fastener or other, similar strapping and attachment means such as a buckle or a hook, is used to wrap around a BCD tank strap 13, which is the strap used to attach the tank to the BCD. The strap 7 maybe of hook material only and a loop pad 10, as shown in FIG. 4, may be provided on the tank cover. As shown in FIG. 3, the strap may be of hook material on one side and of loop material on the other side, so that it can be folded over and attached to itself. The object of the strap 7, or the strap 7 and the loop pad 10, is to keep the air tank from sliding out of the BCD tank strap which may occur when the BCD tank strap clip accidentally opens.

In a further embodiment, as illustrated in FIG. 3, the tank cover is provided with a bottom strap 8 or a boot 8' for preventing the tank from slipping out of the tank cover. The main advantage of this embodiment of the invention is for effectively interlocking the tank, tank cover and BCD tank strap, so as to prevent accidental tank slippage below or above the surface of the water.

FIG. 3 further indicates, in dash-dotted lines, a carrying strap 9.

It is noted, the bottom strap 8, which may be a number of straps 8 or a solid plastic or natural material bottom 8' of various dimensions, may be either permanently affixed to the tank cover or it may be removable.

Additionally, a strap 9 may be provided which, again, is either permanently attached to or removable from the tank cover. The strap 9 can be used for carrying the tank, for example, or the tank together with the BCD. Further uses for the top strap or straps 9 are apparent, such as for hanging the tank on a boat, in a land vehicle or for storing in a locker.

Figure 5:
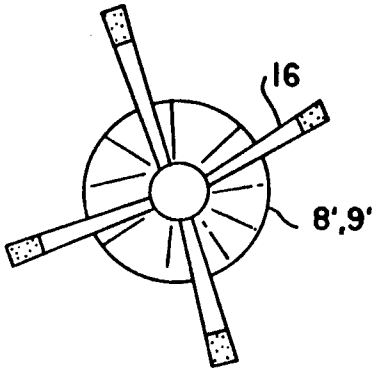
FIG. 5 is a top-plan view of a bonnet for attaching to the top or the bottom of the tank cover.
Figure 6:
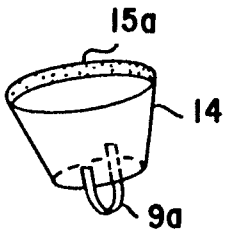
FIG. 6 is a perspective view of a second embodiment of a bonnet for attaching to the bottom of the tank cover.

In the alternative, the top strap 9 may be in the form of a "bonnet" as shown in FIGS. 5 and 6, so that it encloses the top of the tank fully. The purpose, again, may be either to protect the tank or to hide damage to the tank and to fully change the outer appearance of the tank. The bonnet 8', 9' or the alternative bottom bonnet 14 is of a conical or frustoconical shape with a top cut off to allow the tank head to pass through. The top edge may be elastic or have a tightening string. The bottom edge may be elastic or be capable of being affixed by velcro or hooks.

Finally, an additional strap 16 is shown in FIG. 2. Again, it may be permanently attached to or be removable from the top and/or from the bottom of the tank cover 2. The strap 10 may be adjustable and may be used as a handle or shoulder strap to transport the tank in a horizontal manner.

As shown in FIGS. 2 and 4, there are two loops 11 provided in the vicinity of the top of the tank cover which serve several purposes. The loops 11 may be used to slip the tank cover over the air tank 1 for removal. Several D-rings 12 are distributed over the non-stretchable portion of the tank cover tube 2. The rings or latch hooks 12 are used for attaching additional straps or belts, for charging the tank up and/or as a handle for slipping the tank cover over the air tank and for attaching a clip/strap 17, illustrated in FIG. 7, for attaching other gear and accessories. The clip/strap 17 is a two-sided VELCRO attachment strap, i.e. one side being hook material and the other side being loop material. Instead of the rings, clips, snaphooks, buckles, latches or similar fastening devices may be used.

The bonnet 8', 9' of FIG. 5 is shown with four straps 16. Each of the straps 16 is shown with a VELCRO connector patch but other forms of attachment may be used as well, such as buckles, rings, etc. The tank cover proper will be equipped with matching attachment means. The bonnet 8', 9' may be utilized either on the top or on the bottom of the tank.

The bonnet 14 shown in FIG. 6 has a VELCRO strip **15*a* attached around the inside top portion thereof. A matching strip 15*b* is placed on the tank cover, such that the bonnet 14 is simply slipped onto the tank bottom and the VELCRO strips 15*a* and 15*b*** are engaged.

I claim:

1. A protective cover for SCUBA air tanks, comprising a tube of flexible material for snugly fitting around a body of a tank, said tube including a substantially non-stretchable portion of material having two side edges, a resiliently stretchable portion of material disposed between said two side edges, for allowing said tube to snugly fit tanks of various sizes, means disposed on said tube for allowing a diver to attach said tube to a diver's vest and to detach said tube from the diver's vest, and an attachment pad disposed on said substantially non-stretchable portion for accessibly attaching auxiliary diving equipment.

2. The protective cover according to claim 1, wherein the body of the tank includes a cylindrical body portion with a given height and a top portion, and wherein said tube has a length adapted to the given height.

3. The protective cover according to claim 1, wherein said attachment pad is a loop pad of a hook-and-loop fastening material.

4. The protective cover according to claim 1, wherein said attachment pad is a plurality of pads disposed on said non-stretchable portion.

5. The protective cover according to claim 1, wherein said resiliently stretchable portion is in the form of a plurality of resilient strips.

6. The protective cover according to claim 1, wherein said resiliently stretchable portion is in the form of a strip extending along said tube.

7. The protective cover according to claim 1, including attachment means disposed on said non-stretchable portion for attaching auxiliary diving equipment.

8. The protective cover according to claim 7, wherein said attachment means are selected from group consisting of rings, snap-hooks, buckles and latches.

9. The protective cover according to claim 8, wherein said attachment means is in the form of a plurality of rings disposed on said non-stretchable portion for attaching hooks and auxiliary straps to the tank.

10. The protective cover according to claim 1, wherein the tank has a bottom, and including means for attaching said tube to said bottom for preventing the tank from slipping out of said tube.

11. The protective cover according to claim 10, wherein said attaching means is a strap.

12. The protective cover according to claim 1, wherein the tank has a top, and including means for attaching said tube to said top for preventing the tank from slipping out of said tube.

13. The protective cover according to claim 12, wherein said attaching means is a strap.

14. The protective cover according to claim 1, wherein said attachment means include an attachment strap disposed on said non-stretchable portion for releasably attaching the cover to a tank strap of a buoyancy compensation device.

15. The protective cover according to claim 1, wherein said tube has a bottom and a top, and including a carrying strap attached to said tube in the vicinity of said bottom and said top.

16. In combination, a diver's vest and a protective cover for SCUBA air tanks to be releasably attached to the diver's vest, said protective cover comprising a tube of flexible material for snugly fitting around a body of a tank, said tube including a substantially non-stretchable portion of material having two side edges, and a resiliently stretchable portion of material disposed between said two side edges, for allowing said tube to snugly fit tanks of various sizes, and means for allowing a diver to attach said tube to the diver's vest and to detach said tube from said diver's vest.

* * * * *